United States Patent [19]

Hunter, Jr.

[11] 4,073,081

[45] Feb. 14, 1978

[54] CHANGEABLE MESSAGE SIGN WITH SINGLE MESSAGE DISPLAY OPENING

[76] Inventor: E. Tait Hunter, Jr., 384 Redwood Drive, Marietta, Ga. 30060

[21] Appl. No.: 728,860

[22] Filed: Oct. 1, 1976

Related U.S. Application Data

[63] Continuation-in-part of Ser. No. 602,788, Aug. 7, 1975, Pat. No. 3,983,648, which is a continuation-in-part of Ser. No. 399,537, Sept. 21, 1973, Pat. No. 3,919,794.

[51] Int. Cl.[2] ..... G09F 11/02

[52] U.S. Cl. ..... 40/470; 40/505

[58] Field of Search ..... 40/77.7, 30, 77.4, 33, 40/77, 77.6; 58/126 R, 125 R

[56] References Cited

U.S. PATENT DOCUMENTS

| | | | |
|---|---|---|---|
| 676,235 | 6/1901 | Jackson | 40/77.7 |
| 1,652,335 | 12/1927 | Wiley | 40/77.7 X |
| 3,983,648 | 10/1976 | Hunter | 40/77.7 X |
| 4,002,022 | 1/1977 | Lopez | 40/77.7 X |

*Primary Examiner*—John F. Pitrelli
*Attorney, Agent, or Firm*—Jones, Thomas & Askew

[57] ABSTRACT

Movable message sign apparatus having a single message display opening, and a number of back-lighted message display members mounted within the opening. Each message display member includes a translucent message member having a pair of message faces which form an open V configuration. The message members are attached to end members that are pivotally mounted, so that there is no need for an axle extending through a message display member. The message display members are oscillated in unison between message display positions which place either a first set or a second set of message faces in message display alignment with the opening. A source of back lighting is provided at a sufficient distance behind the message members to avoid streaking or other localized intense illumination. Each message member has flanges which enhance the rigidity of the member and which prevent direct viewing of the illumination source.

5 Claims, 9 Drawing Figures

CHANGEABLE MESSAGE SIGN WITH SINGLE MESSAGE DISPLAY OPENING

This is a continuation-in-part of Ser. No. 602,788 filed Aug. 7, 1975 and now U.S. Pat. No. 3,983,648; which is in turn a continuation-in-part of Ser. No. 399,537 filed Sept. 21, 1973 and now U.S. Pat. No. 3,919,794.

This invention relates in general to message display apparatus and in particular to sign apparatus for sequentially displaying multiple messages.

It has been proposed to provide message display signs which are capable of sequentially and repetitively displaying a number of different messages, such signs being typically but not necessarily used for advertising or promotional purposes. Examples of such signs are found in the two related patents identified above, in which are disclosed signs that automatically display separate sets of sequentially-changing repetitive messages in each of two separate aligned message display openings. The signs of the aforementioned patents include various provisions for filling the unsightly gaps which otherwise periodically appear at upper and lower ends of the message display opening as the message display elements oscillate between the two message display positions. The aforementioned U.S. Pat. No. 3,919,794 also shows that the message display elements can be internally illuminated by a lamp mounted axially within the message display element.

While changeable message signs as shown in the two aforementioned patents constitute an improvement over fixed-message signs, as well as over other and more complex types of sign message changing mechanisms, a need exists for a changeable-message sign which is even simpler and more economical to construct and operate. Such a sign would require only a single message display surface, since the sign would be typically mounted or displayed in a shop window or other location where the full utility of a double-side sign could not be utilized. A changeable-message sign of this type should be self-illuminated, however, and is preferably internally illuminated to provide a uniform and glarefree message presentation. It has been found, however, that attempts to merely scale down existing changeable-message signs with internally-illuminated elements causes localized streaks or other "hot spots" of illumination on the message display surfaces, resulting from placement of the axially-disposed lamps too close to such surfaces.

Accordingly, it is an object of the present invention to provide improved multiple message sign apparatus.

It is another object of the present invention to provide an improved internally illuminated multiple message sign apparatus.

It is still another object of the present invention to provide a multiple message sign having improved apparatus for selectively filling gaps which would otherwise appear in the message display area as message display changes occur.

The foregoing and other objects and advantages are provided by the present invention which, stated in general terms, includes a number of message display members having a longitudinal open side configuration, having end members which are mounted for rotation along parallel coplanar axes, and having a source of illumination disposed behind the plane of rotation. No axle or other structure which could cast a shadow on the backlit messages is present within the message display members, and the illumination source is positionable a sufficient distance away from the message faces to avoid localized hot spots of illumination. The end members of the message display members are connected together for oscillation in unison, preferably by separate links extending along both ends of the message support members, and means are provided to block the escape of direct illumination between adjacent message support members.

The present invention is better understood with reference to the disclosed embodiments shown in the drawing, in which.

Figure 4A:
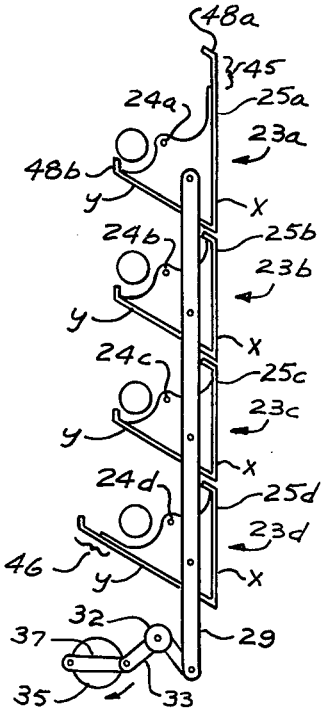
Figure 4B:
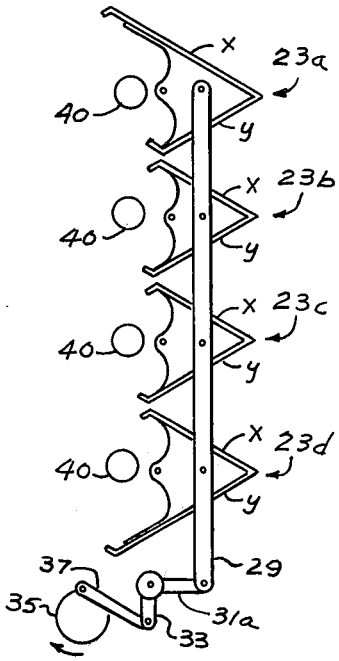
Figure 4C:
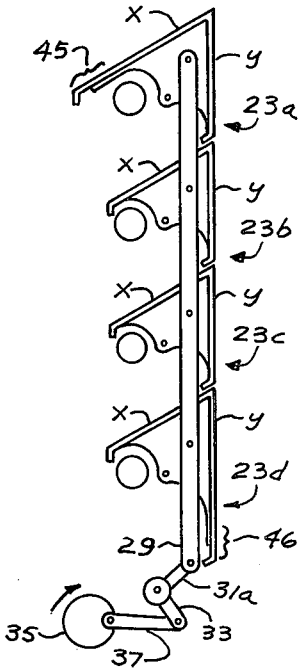
Figure 5:
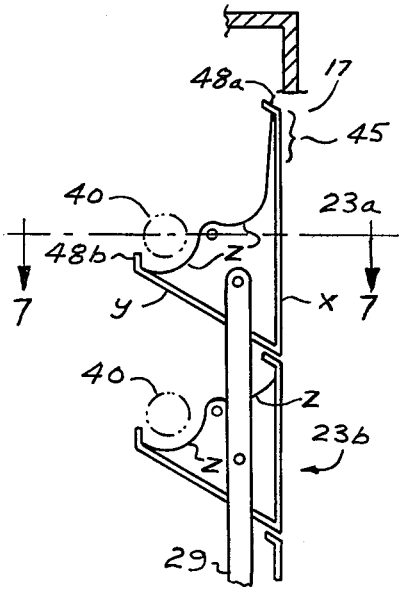
Figure 6:
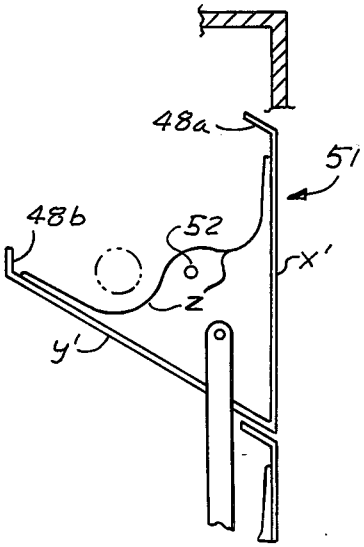
Figure 7:
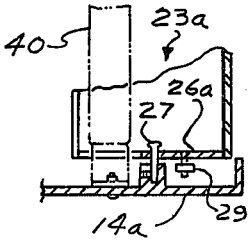

FIGS. 4A, 4B, and 4C are side elevation views, with the external housing omitted for illustrative purposes, showing the disclosed embodiment in a sequence of oscillation between first and second message display positions;

FIG. 5 is a fragmentary section view taken along line 2—2, also omitting the side frame for clarity and showing the gap blocking structure;

FIG. 6 is a fragmentary section view of a modified embodiment of the present invention, also omitting the side frame for clarity; and FIG. 7 is a fragmentary section view taken along line 7—7 of FIG. 5, showing the pivotal mounting of message support members.

Figures 1, 2, 3:
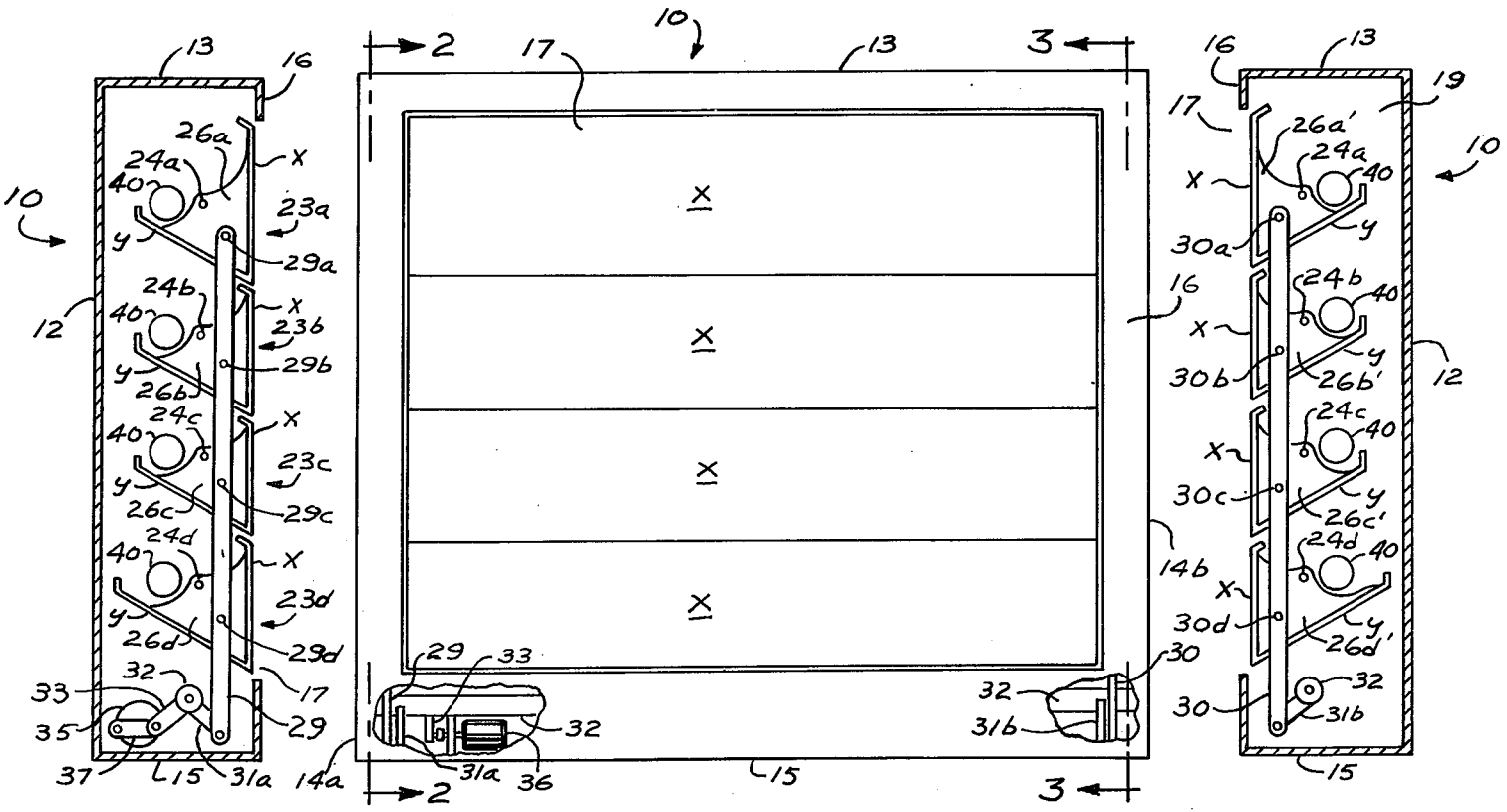
FIG. 1 is a front elevation view of a changeable message sign according to a disclosed embodiment of the present invention.
FIG. 2 is a section view taken along line 2—2 of FIG. 1, omitting the side frame member for clarity.
FIG. 3 is a section view taken along line 3—3 of FIG. 1, omitting the side frame member for clarity.

Turning to FIGS. 1-3, there is shown a changeable message sign indicated generally at 10 and having a housing which includes a back member 12, a top member 13, side members **14*a* and 14*b*, a bottom member 15, and a front face 16 which surrounds and defines a message display opening 17. The back member 12 may be removable from the remainder of the housing, for access to the interior region 19** of the apparatus.

Mounted within the interior region 19 of the sign apparatus is a series of message display members **23*a*, 23*b*, 23*c*, and 23*d*, with each message display member being supported for oscillation on corresponding axes 24*a*–24*d*** which are mutually parallel and coplanar.

Each of the message display members **23*a*–23*d* consists of two end members 26*a*–26*d* and 26*a*′–26*d*′, respectively. Each of the end members 26*a*–26*d* is pivotally connected for oscillation on the corresponding axes by a suitable axle or other rotational support, such as the axle pin 27 shown in FIG. 7, extending from the end member to the adjacent side member 14*a* of the sign apparatus, while each of the other end members 26*a*′λ –26*d*′ is similarly supported for pivotal movement by a separate axle member (not shown) which extends outwardly to the respective adjacent side member 14*b*. No axle or other structure extends between the end members within the message display members 23*a*–23*d***.

Each of the message display members **23*a*–23*d* also includes a corresponding message member 25*a*–25*d* which is made from a suitable translucent material and positioned between adjacent end members such as end members 26*a* and 26*a*′ of message display member 23*a*. Each message member is detachably connected to its corresponding pair of end members by clips, screws, or any other appropriate detachable fastening device which allows the message member to be readily removed from the end members for substitution of new message members. Each message member 25*a*–25*d*** has a pair of message faces *x* and *y*, which may be of unitary construction, and it will be understood by those skilled in the art that each of the several message faces *x* and *y* will contain part of a desired message which may either be printed on the faces of the removable message members or may be applied to such faces by separate letters or other symbols. The two message faces *x* and *y* intersect along a common longitudinal line to form the message member in the shape of a V whose open portion faces the back member 12 of the sign 10.

Each of the end members 26*a*–26*d* at one end of the message display members is interconnected to a common drive link 29 at respective pivot points 29*a*–29*d*, and the end members 26*a*'–26*d*' are likewise connected together with a drive link 30 at pivot points 30*a*–30*d*. The drive links 29 and 30 are connected by respective interconnecting torque arms 31*a*, 31*b* which are attached to opposite ends of a torque tube 32 which is mounted for oscillation within the bottom member 15 of the sign apparatus, adjacent to an end message display member such as 23*d*. The torque tube 32, which is parallel to the rotational axes 24*a*–24*d* of the message display members and is preferably coplanar with the message display member axes, is driven for oscillation by a drive wheel 35 which is rotated by a suitable motor 36. Link 37 interconnects the drive wheel 35 and the torque tube 32 through arm 33. Alternatively, the torque tube can be noncoplanar with the axes of the message support members, in which case an additional link would be required between each of the torque arms 31*a*, 31*b* and the respective drive links 29, 30.

The oscillation of the message display members between the two message display positions is best understood with reference to FIGS. 4A, 4B, and 4C. In the first message display position depicted by FIG. 4A, the link 29 (and also the link 30, not shown in FIGS. 4A–4C) is in a lowermost position and all message display members 23*a*–23*d* are oscillated to place the message faces *x* in parallel coplanar adjacent alignment with each other, as would be viewed through the message display opening 17 seen in FIG. 1. As the drive wheel 35 is rotated in a clockwise direction as seen in FIG. 4B, the link 37 commences to rotate the torque tube 32 via arm 33 in a counterclockwise direction which moves the drive links 29 and 30 upwardly, causing the message display members 23*a*–23*d* to rotate in unison about their respective axes. When the drive wheel 35 rotates to the position shown in FIG. 4C, the drive link 29 is moved to its uppermost position and the message faces *y* are now aligned in the message display opening 17, providing the second message display position of the sign apparatus 10. Further clockwise rotation of the drive wheel 35 causes the sign to revert to the first message display position shown in FIG. 4A. It will be appreciated that the geometry of the drive mechanism for the message display members should be selected to provide an extent of dwell time at each of the two message display positions, here seen in FIGS. 4A and 4C.

The provision of separate drive links 29 and 30 at opposite ends of the message display members permits each such member to be oscillated about its axis without requiring a power-driven axle extending through the message display member, and without applying any bending or twisting torque to only one end of the message display member. It is recognized, however, that only a single drive link 29 at one end of the message display members will be required if the translucent message members 25*a*–25*d*, and the attachments to the respective end members of the message members, are sufficiently strong to withstand torsional movements resulting from oscillating drive at one end only of the message display members. In such case, it will also be understood that the torque tube 32 can also be eliminated and the drive link 37 from wheel 35 could be positioned below and connected to the drive link 29.

Turning to FIGS. 2, 3, and 5, it is seen that a fixed source of internal illumination for the sign apparatus 10 is provided by one or more lamps 40 separately positioned behind the pivot axes 24*a*–24*d* of each respective message display member 23*a*–23*d*. The lamps 40 may be conventional fluorescent or incandescent lamps which are mounted in standard commercial lamp-holding fixtures extending between the side members 14*a* and 14*b* of the sign apparatus 10, as partially illustrated in FIG. 7, and it will be understood that each lamp 40 is mounted a sufficient distance in back of the front face 16 of the sign so that the translucent message members 25*a*–25*d* are illuminated substantially uniformly, without streaks or other hot spots of illumination which would otherwise occur if the lamps 40 were positioned too close to the message members. It is thus seen that the open sided construction of the message members, such as the depicted open-V configuration, combined with the absence of an axle extending within the message display members, allows the lamp 40 or other illumination source to be positioned behind the axis of rotation for each message display member, so that a more uniform and shadow-free illumination of the message faces *x* and *y* is provided. This behind-the-axis illumination permits the overall size of the message display members to be reduced if desired, so that the sign apparatus 10 can be reduced to a compact size which is more readily compatible with store window displays and other applications where a relatively compact sign having multiple-message capability is desired.

The end members 26*a*–26*d* and 26*a*'–26*d*' are suitably profiled as shown at Z, FIGS. 5 and 6, to accommodate the lamps 40 without interference as the message display members are oscillated. To obtain optimized lamp clearance in small message support signs according to the present invention, the pivot axis 24*a*–24*d* of each respective message display member is located at a relative position that would constitute the mid point of the base of an isosceles triangle defined by the ends of the two message faces *x* and *y*. It is apparent from the geometry of the message display members shown in FIGS. 1–5 that oscillation of the message display members would result in an unsightly gap being created at the top of the first message display position of aligned face *x* of message display member 24*a* and the adjacent upper portion of the front face 16, and between the second message display position formed by face *y* of message display member 24*d* and the bottom portion of the front face 16, as the message display members are oscillated in unison. To prevent such gaps from occurring, the message face *x* on the uppermost message display member 23*a* is extended as shown at 45, and the message face *y* on the lowermost message display member 23*d* is extended as shown at 46, so that such extensions will alternately move into position to occupy the unsightly gaps that would otherwise be present as the sign oscillates.

While the message display members confront one another in close proximity in the message viewing positions shown in FIGS. 4A and 4C, a gap between adjacent message display members, which would result in direct and possibly distracting viewing of the lamps 40, can occur. The occurrence of such light gaps between adjacent message display members is eliminated by providing flanges 48*a* and 48*b* on each message display 25*a*–25*d* along the length of the respective message faces *x* and *y*, at the unsupported longitudinal edges thereof and turned inwardly toward the open side of the message display member to block the direct illumination that would otherwise escape through the gaps between the message display members. The flanges 48*a* and 48*b* also function as stiffeners for each of the message members 25*a*–25*d*, thereby increasing the structural strength of the message display members so that such members may be fabricated from relatively light and less expensive materials. The flanges 48*a* and 48*b*, as best seen in FIGS. 4A–4C and 5, may have outer surfaces which are substantially parallel with the confronting message faces of adjacent message support members, so that the flanges do not cause interference with adjacent message display members during oscillation.

In larger signs where the overall depth of the message display members positions the lamps at a suitable distance from the message faces for satisfactory illumination, each of the message display members may be identical as shown by the exemplary message support member 51 in FIG. 6. In this case, the ends of each message face *x'* and *y'* form two sides of an essentially equilateral triangle, and the pivot axis 52 of the message display member 51 is at the centroid of such equilateral triangle. It can be seen that the geometry of a message display member as in FIG. 6 precludes the formation of gaps at either of the two message display positions, so that the extensions 45 and 46 of end message display members, as previously shown in FIGS. 4A and 4C, are unnecessary with the configuration of FIG. 6.

It will be understood that the foregoing relates only to preferred embodiments of the present invention, and that numerous changes and modifications may be made therein without departing from the spirit and the scope of the invention as defined in the following claims.

I claim:

1. Changeable message, sign apparatus comprising:

a housing defining a message display region and having a face defining a message display opening which is open to said message display region;

an array of separate elongated message display members disposed in said message support region for oscillation on respective parallel coplanar axes;

each of said message display members including a pair of illumination-transmissive message faces to form a message member having an open side, and additionally including separate end members attached to said message faces at opposite ends thereof;

each of said message display members being supported for oscillation in said message display region by pivot means which extend from said housing to said end members but which does not extend within said message member;

a separate source of illumination fixedly mounted within said housing behind and within said open side of each of said open message display members so that said message faces are back-lighted;

each of said illumination sources being elongated and disposed in substantially parallel alignment with the axis of rotation of a corresponding said message display member;

each of said illumination sources being located behind the corresponding axis of rotation of the respective message display member to provide substantially uniform internal illumination of said message faces; and each of said message faces having a flanged extension portion extending a distance rearwardly from an unsupported longitudinal edge thereof in substantially parallel alignment with the confronting undisplayed message face of the adjacent message display member, so that said flanged extension portions block direct illumination which would otherwise pass from said illumination sources through gaps between said message display members during oscillation between first and second message display positions, without interfering with adjacent message display members during said oscillation; and means operatively connected to each of said message display members for oscillating each of said message display members in unison about said axes to either a first message display position, whereat a first face of each said message member is aligned in said message display opening, or to a second message display position, whereat a second face of each said message member is aligned in said message display opening;

each of said message faces including said flanged extension portion comprises a unitary member which is connected between said separate end members of said message display members, whereby said flanged extensions provide enhanced torsional stiffness for each message member;

each said elongated illumination source is longer than the corresponding message display member; and each of said end members of said message display members has a pair of recesses which accommodate said illumination source without interference as said message display member oscillate.

2. Apparatus as in claim 1, wherein said oscillating means comprises:

a first link pivotably connected to each end member at one end of each said message display member;

a second link pivotably connected to each end member at the other end of each said message display member; and motive means connected to oscillate said first and second links in unison to move said end members and the attached message members between said first and second message display positions.

3. Apparatus as in claim 2, wherein said motive means comprises a torque tube to be driven for oscillation and connected to oscillate each of said links.

4. Apparatus as in claim 1, wherein:

each of said message faces at the attachment to said end member comprises a side of an equilateral triangle; and said pivot means are disposed at the centroid of the respective said equilateral triangles.

5. Apparatus as in claim 1, wherein:

said message faces of each message support member are offset with respect to the rotational axis of each corresponding message display member so that a gap exists between an edge of said housing face and a particular message face of the adjacent message display member in one of said message display positions; and said particular message face of each said adjacent message display members is extended to occupy said gap.

* * * * *